US006467201B1

(12) United States Patent
McSharry et al.

(10) Patent No.: US 6,467,201 B1
(45) Date of Patent: Oct. 22, 2002

(54) TRENCH-CUTTING MACHINE WITH CUTTING HEAD LOCK MECHANISM

(76) Inventors: Chris McSharry, 7724 Bebe Branch, Ooltewah, TN (US) 37363; Herbert E. Jakob, 9221 Rocky Cove Dr., Chattanooga, TN (US) 37421

( * ) Notice: Subject to any disclaimer, the term of this patent is extended or adjusted under 35 U.S.C. 154(b) by 0 days.

(21) Appl. No.: 09/891,553

(22) Filed: Jun. 26, 2001

(51) Int. Cl.[7] ..... E02F 5/08; E21C 25/00; B28D 1/04

(52) U.S. Cl. ..... 37/347; 37/92; 125/13.01; 125/14; 299/39.1

(58) Field of Search ..... 299/36.1, 39.1, 299/39.3, 39.6; 37/347, 352, 353, 355, 365, 92; 125/13.01, 14

(56) References Cited

U.S. PATENT DOCUMENTS

| | | | | |
|---|---|---|---|---|
| 3,094,047 | A | 6/1963 | Patton | |
| 3,680,919 | A | 8/1972 | Rear et al. | |
| 4,392,689 | A | 7/1983 | Moore et al. | |
| 4,542,940 | A | 9/1985 | Marten | |
| 4,797,025 | A | 1/1989 | Kennedy | |
| 5,308,151 | A | 5/1994 | Sugden et al. | |
| 5,315,770 | A | 5/1994 | Campbell | |
| 5,575,538 | A | 11/1996 | Gilbert et al. | |
| 5,582,490 | A | 12/1996 | Murray | |
| 5,809,670 | A | 9/1998 | Yoder et al. | |
| 6,203,112 | B1 * | 3/2001 | Cook et al. | 125/13.01 |

* cited by examiner

*Primary Examiner*—David Bagnell
*Assistant Examiner*—Brian Halford
(74) *Attorney, Agent, or Firm*—Chambliss, Bahner & Stophel, P.C.

(57) ABSTRACT

A self-propelled trench-cutting machine includes a chassis and a drive assembly mounted to the chassis for driving the machine along a surface to be cut. The machine includes a boom and a rock cutting wheel that is mounted on the boom for rotation about a wheel axis. The boom has a first end and a second end and is mounted along a side of the chassis for pivotal movement about a pivot axis at the first end. A mechanism is provided for rotating the rock cutting wheel about the wheel axis, and a locking mechanism is provided that is adapted to lock the second end of the boom to the chassis.

12 Claims, 4 Drawing Sheets

TRENCH-CUTTING MACHINE WITH CUTTING HEAD LOCK MECHANISM

FIELD OF THE INVENTION

This invention relates generally to a excavating machines, and more particularly to a trench-cutting machine that is adapted to cut through rock, dirt and/or pavement. More particularly, the invention relates to an excavating machine having a rotary cutting wheel that is mounted on a boom which is carried on a chassis.

BACKGROUND AND DESCRIPTION OF THE PRIOR ART

It is often necessary to dig relatively narrow trenches to receive television cables, fiber optic cables, drainage lines and utility lines through packed earth, concrete, asphalt or even solid rock. Such materials are typically too hard to be excavated by conventional chain-type trenchers; however, trenchers of the rocksaw type have been found to be ideally suited for this task. The conventional rocksaw trencher includes a rotary wheel having a plurality of cutting teeth mounted around the periphery. The wheel is typically mounted on a boom that is disposed along the centerline of the machine between a pair of track assemblies. The boom is pivotally mounted to the chassis of the machine at one end. Such machines are described in U.S. Pat. No. 3,680,919 of Rear et al., U.S. Pat. No. 4,542,940 of Marten, U.S. Pat. No. 5,575,538 of Gilbert et al. and U.S. Pat. No. 5,809,670 of Yoder et al. The cutting wheels of most of these machines are hydrostatically powered, although the machines of Rear et al. and Yoder are chain-driven.

All of these prior devices include one or more disadvantages. For example, each of them is mounted to a boom that extends beyond the end of the chassis and is supported at only one end. When such a machine is operated to cut through material of varying hardness, such as rock embedded in dirt, the cutting wheel may tend to "float" or "bump" upwardly when it encounters the harder material, thus producing a cut of non-uniform depth. In addition, mounting of the cutting wheel along or near the centerline of the machine prevents the machine from making a cut near a fence line, bridge support or other obstacle. Finally, the machines that are hydrostatically powered involve complex and expensive wheel-driving components, yet may have insufficient power to cut through hard rock at a reasonable rate. Furthermore, the chain-driven cutting wheels of Rear et al. and Yoder involve complex frame and roller assemblies, in addition to a chain and sprocket drive, that could be fouled or jammed by rocks and dirt produced during cutting.

It would be desirable if a rocksaw-type trenching machine could be developed that would avoid the disadvantages of the previously-known devices.

ADVANTAGES OF THE INVENTION

Among the advantages of the invention is the provision of a rocksaw trenching machine that includes a cutting wheel that is mounted within the main frame of the machine rather than extending off one end of the machine. Another advantage of the invention is the provision of such a machine having a cutting wheel mounted on a boom that may be supported by the chassis at both ends. Still another advantage of the invention is the provision of a rocksaw trenching machine that includes a cutting wheel that is mounted along one side of the machine. Yet another advantage of a preferred embodiment of the invention is the provision of such a machine that includes a simple mechanical drive for the cutting wheel. Another advantage of a preferred embodiment of the invention is the provision of such a machine having a cutting wheel that is adapted to cut downwardly as the machine is operated.

Additional advantages of this invention will become apparent from an examination of the drawings and the ensuing description.

SUMMARY OF THE INVENTION

The invention comprises a self-propelled trench-cutting machine which includes a chassis and a drive assembly mounted to the chassis for driving the machine along a surface to be cut. The machine includes a boom having a first end and a second end. The boom is mounted along a side of the chassis for pivotal movement about a pivot axis at the first end. A rock cutting wheel is mounted on the boom for rotation about a wheel axis, and means are provided for rotating the rock cutting wheel about the wheel axis. The machine also includes a locking mechanism that is adapted to lock the second end of the boom to the chassis.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
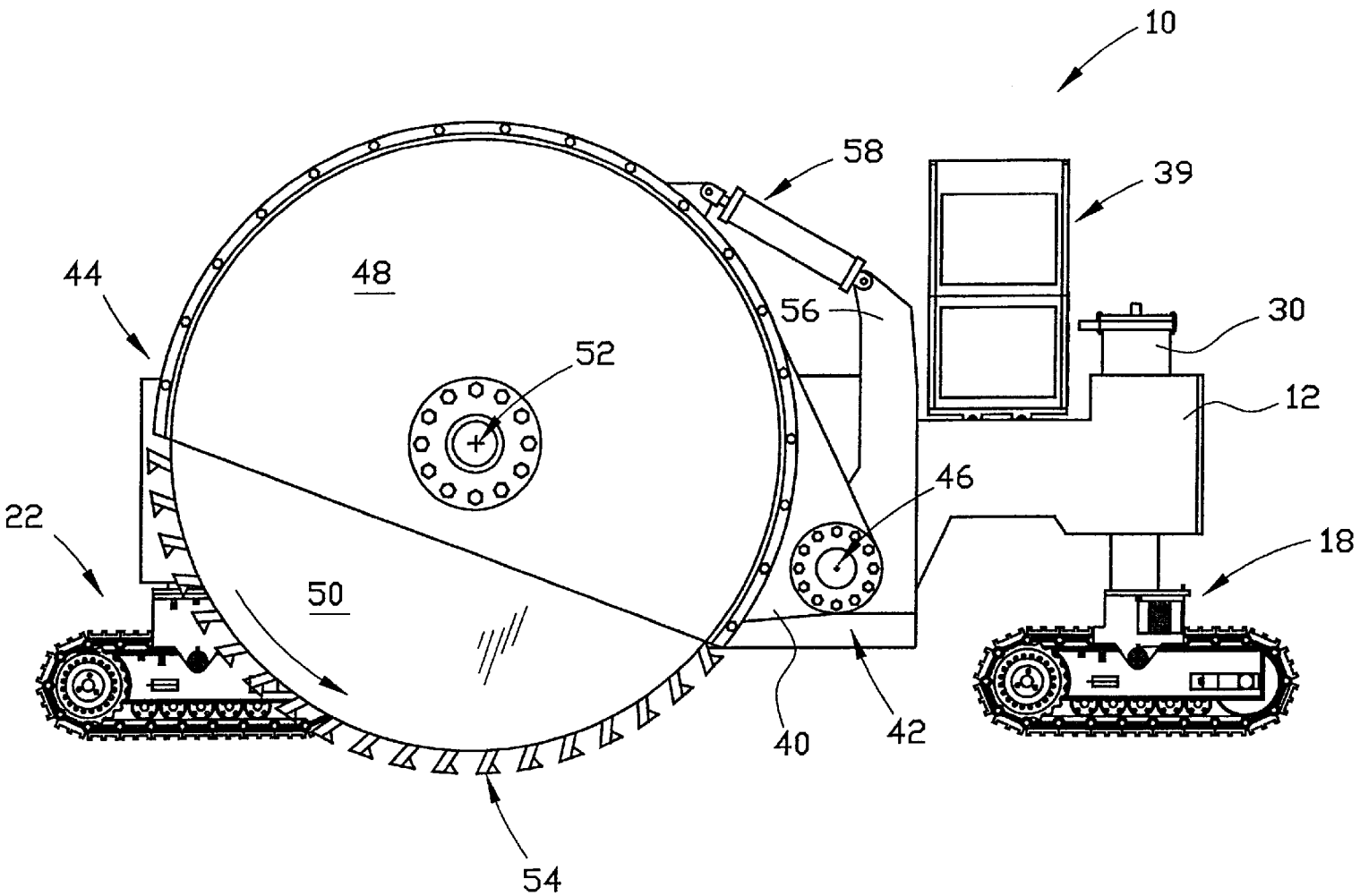
FIG. 1 is a right side view of a preferred embodiment of the invention.
Figure 2:
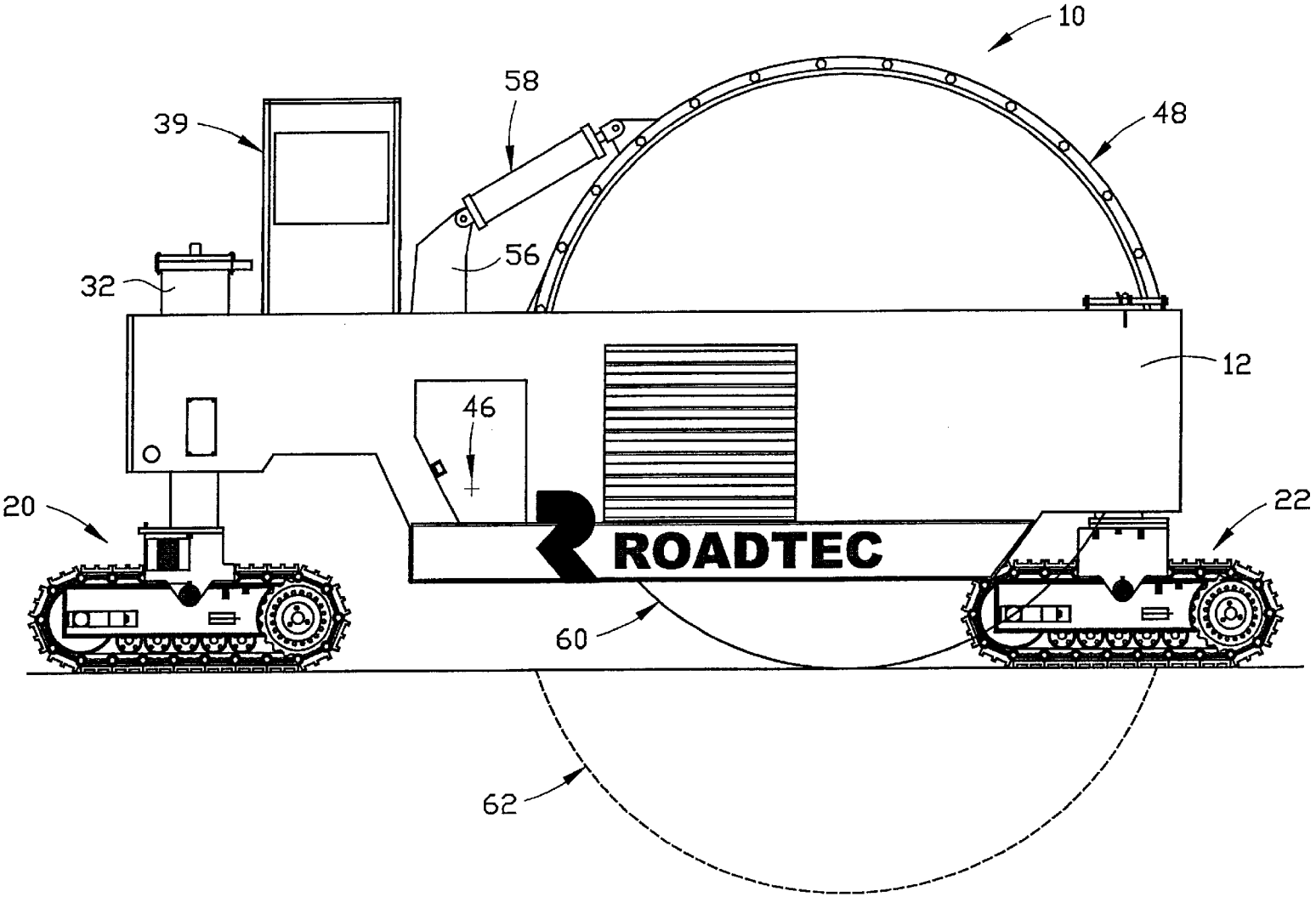
FIG. 2 is a left side view of the embodiment of FIG. 1.
Figure 3:
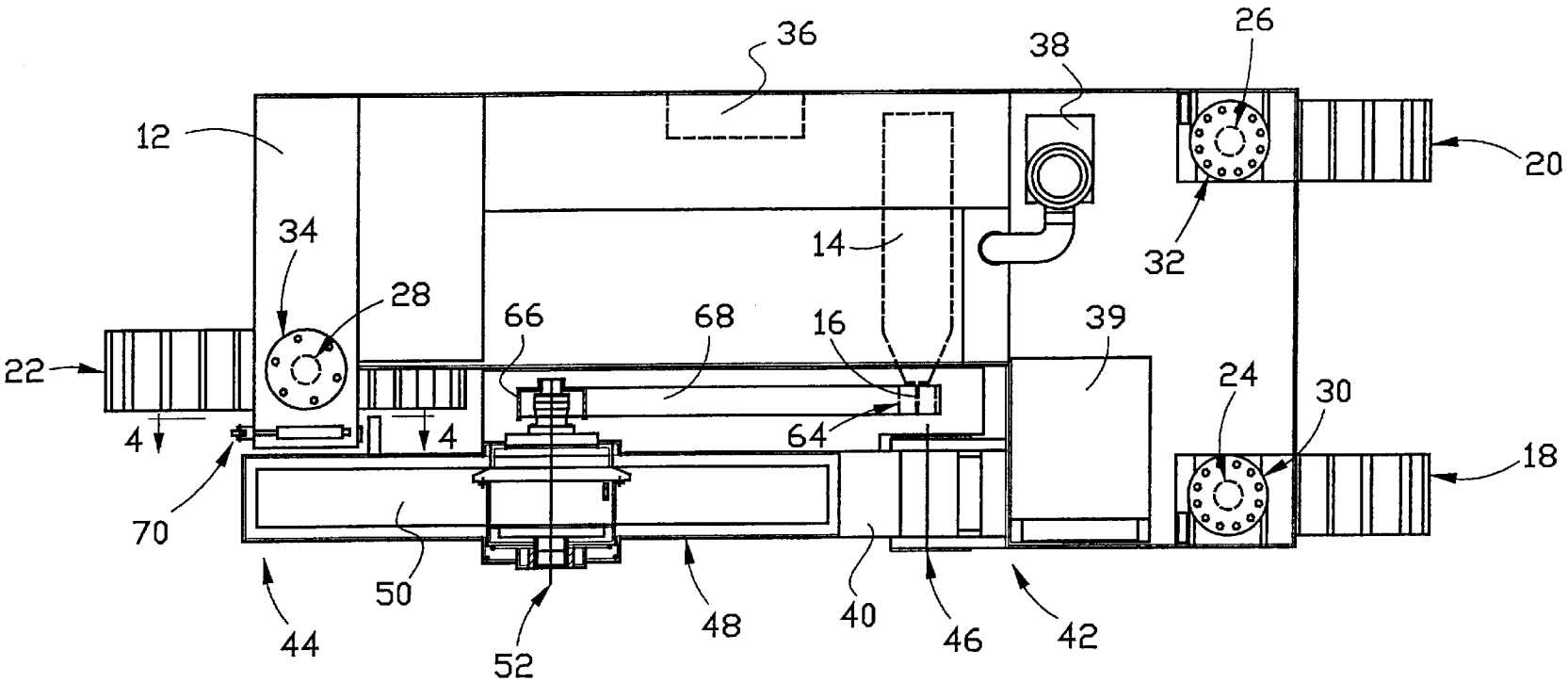
FIG. 3 is a top view of the embodiment of FIGS. 1 and 2.

Referring now to the drawings, a preferred embodiment of the invention is illustrated in FIGS. 1–3. Rocksaw-type trenching machine 10 includes chassis 12 and a drive assembly mounted to the chassis for driving the machine along a surface to be cut. The drive assembly includes an engine 14 having a drive shaft 16. The engine is operatively connected to right track assembly 18 (FIG. 1), left track assembly 20 (FIG. 2), and rear track assembly 22, all of which are mounted to the chassis. Preferably, the engine is operatively connected for driving the track assemblies by means of one or more hydraulic pumps (not shown), such as are known to those having ordinary skill in the art to which the invention relates. In the preferred embodiment of the invention, one or more hydraulic pumps (not shown) are also preferably provided for driving hydraulic actuators 24, 26 and 28 (FIG. 3) which are located inside track assembly tubes 30, 32 and 34 respectively, and which are adapted for raising and lowering the chassis with respect to the track assemblies. One or more hydraulic fluid tanks and hydraulic fluid piping and controls such as are known to those having ordinary skill in the art to which the invention relates (not shown) are also provided in the preferred embodiment of the invention. It is also preferred that at least one of the track assemblies, most preferably rear track assembly 22, is steerable about a vertical axis through tube 34 (see FIG. 3) by means known to those having ordinary skill in the art to which the invention relates.

In the preferred embodiment of the invention illustrated in the drawings, engine 14 is provided with radiator 36 and exhaust/muffler system 38. Operator's cab 39 is preferably provided at the front end of the chassis, as shown in FIGS. 1–3.

The invention includes boom 40 having first end 42 and second end 44. The boom is mounted along a side of the chassis for pivotal movement about pivot axis 46 at the first end. The boom comprises rock cutting wheel guard 48 which partially encloses rock cutting wheel 50 that is mounted on the boom for rotation about wheel axis 52. Cutting wheel 50 is provided with a plurality of cutting teeth 54, as shown in FIG. 1, which are preferably arranged so as to cut downwardly when the cutting wheel is rotated in the direction indicated by the arrow. The boom is supported on the chassis of the preferred embodiment by arm 56 and hydraulic cylinder 58.

As shown in FIG. 2, extension and retraction of hydraulic cylinder 58 raises and lowers the cutting wheel between a first position indicated by line 60 and a second position indicated by line 62. A hydraulic pump (not shown), preferably the same pump that drives hydraulic actuators 24, 26 and 28, is provided for actuating cylinder 58, along with the necessary hydraulic fluid tank and piping and controls (not shown) such as are known to those having ordinary skill in the art to which the invention relates.

The invention also includes means for rotating the rock cutting wheel about the wheel axis. Although such means may include a separate motor or engine that is directly attached to the cutting wheel, or a mechanism for attachment of engine 14 to the wheel by means of a hydraulic pump drive similar to that used to drive the preferred track assemblies, it is preferred that drive shaft 16 of engine 14 be mounted directly to the rock cutting wheel by means of pulleys 64 and 66 and drive belt 68 (FIG. 3), so that the wheel may be rotated about the wheel axis by the drive shaft of the engine.

Figure 4:
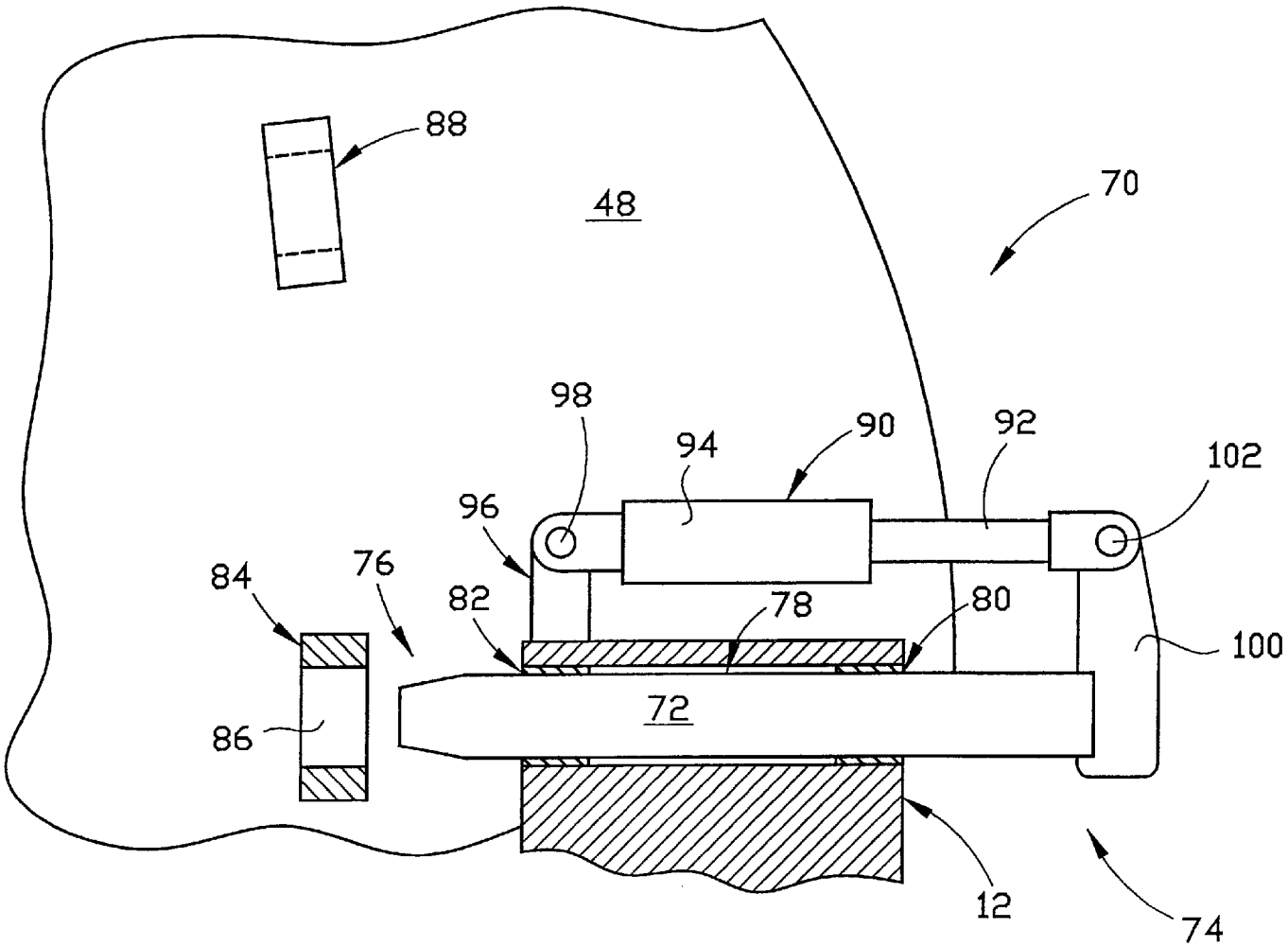
FIG. 4 is an enlarged sectional view of the locking assembly for locking the second end of the cutting wheel boom to the chassis, taken along line 4—4 of FIG. 3.

The invention also includes locking mechanism 70 that is adapted to lock the second end of the boom to the chassis. As shown in FIG. 4, preferred locking mechanism 70 comprises locking pin 72 having first end 74 and second end 76. Locking pin 72 is positioned in locking pin aperture 78, which is provided on chassis 12. Preferably a pair of bushings 80 and 82 are provided within the aperture to facilitate alignment of the locking pin within the aperture and axial movement with respect thereto. The preferred locking mechanism also includes first locking pin receiver 84 that is mounted to the second end of the boom, on the side of cutting wheel guard 48. Receiver 84 includes aperture 86 that is adapted to receive the second end of the pin. Additional locking pin receivers, such as receiver 88, may also be provided so that the locking mechanism may be adapted for locking the second end of the boom to the chassis at a plurality of positions, each of which corresponds to a different angular orientation of the boom about the pivot axis.

The locking pin may be manually moved between a locked position in which the second end of the pin is received in the first locking pin receiver (not shown) and an unlocked position in which the second end of the pin is outside of the locking pin receiver (FIGS. 3 and 4). However, it is preferred that locking mechanism 70 include hydraulic cylinder 90 having piston 92 and cylinder case 94 into which the piston may be retracted for movement of the pin between the locked and unlocked positions. One of the piston and the cylinder case, preferably cylinder case 94, is mounted to the chassis, as by mounting bracket 96 and mounting pin 98, and the other is mounted to the first end of the locking pin, as piston 92 is mounted to first end 74 of locking pin 72 by pin connector 100 and mounting pin 102. The hydraulic cylinder of preferred locking mechanism 70 is disposed generally parallel to the locking pin and is adapted to move the pin between a locked position in which the second end of the pin is received in the first locking pin receiver (not shown) and an unlocked position in which the second end of the pin is outside of the locking pin receiver. Preferably, the hydraulic cylinder is mounted with respect to the locking pin so that upon actuation of the cylinder to retract the piston into the cylinder case, the pin is moved into the locked position (to the left as viewed in FIG. 4).

A hydraulic pump (not shown), preferably the same pump that drives hydraulic actuators 24, 26 and 28, and cylinder 58, is provided for actuating cylinder 90, along with the necessary hydraulic fluid tank and piping and controls (also not shown) such as are known to those having ordinary skill in the art to which the invention relates.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A self-propelled trench-cutting machine comprising:

(a) a chassis;

(b) a drive assembly mounted to the chassis for driving the machine along a surface to be cut, said drive assembly including an engine having a drive shaft;

(c) a boom having a first end and a second end, said boom being mounted along a side of the chassis for pivotal movement about a pivot axis at the first end;

(d) a rock cutting wheel that is mounted on the boom for rotation about a wheel axis;

(e) means for rotating the rock cutting wheel about the wheel axis;

(f) a locking mechanism that is adapted to lock the second end of the boom to the chassis.

2. The machine of claim 1 where the locking mechanism is adapted for locking the second end of the boom to the chassis at a plurality of positions, each of which corresponds to a different angular orientation of the boom about the pivot axis.

3. The machine of claim 1 which includes a hydraulic cylinder mounted between the chassis and the boom for use in pivotally moving the boom about the pivot axis.

4. The machine of claim 1 wherein the wheel is provided with a plurality of cutting teeth that are arranged so as to cut downwardly as the wheel is rotated.

5. The machine of claim 1 wherein the drive assembly includes a plurality of track drives, at least one of which is steerable about a generally vertical steering axis.

6. The machine of claim 5 wherein the chassis is mounted on the track drives so as to be adapted for vertical motion with respect thereto.

7. The machine of claim 1 wherein the rotating means comprises a driving mechanism for operatively coupling the drive shaft of the engine to the rock cutting wheel so that the wheel may be rotated about the wheel axis by the drive shaft.

8. The machine of claim 7 wherein the driving mechanism includes a drive belt.

9. The machine of claim 1 wherein the locking mechanism comprises a locking pin that is mounted for axial movement between a locked position in which the second end of the boom is locked to the chassis and an unlocked position in which the second end of the boom is not locked to the chassis.

10. The machine of claim 9 which includes:

(a) An aperture provided on the chassis for said locking pin;

(b) said locking pin having a first end and a second end, which pin is positioned in the aperture and adapted for axial movement with respect thereto;

(c) a locking pin receiver that is mounted to the second end of the boom, which receiver is adapted to receive the second end of the pin;

(d) a hydraulic cylinder having a piston and a cylinder case into which the piston may be retracted, wherein one of the piston and the cylinder case is mounted to the chassis and the other is mounted to the first end of the locking pin, said hydraulic cylinder being disposed generally parallel to the locking pin and being adapted to move the pin between a locked position in which the second end of the pin is received in the locking pin receiver and an unlocked position in which the second end of the pin is outside of the locking pin receiver.

11. The machine of claim 10 wherein the hydraulic cylinder is mounted with respect to the locking pin so that upon actuation of the cylinder to retract the piston into the cylinder case, the pin is moved into the locked position.

12. The machine of claim 10 wherein the cylinder case is mounted to the chassis and the piston is mounted to the first end of the locking pin.

* * * * *